US011629656B2

(12) United States Patent
Beer et al.

(10) Patent No.: US 11,629,656 B2
(45) Date of Patent: Apr. 18, 2023

(54) DETECTING CYLINDER-SPECIFIC COMBUSTION PROFILE PARAMETER VALUES FOR AN INTERNAL COMBUSTION ENGINE

(71) Applicant: Vitesco Technologies GmbH, Hannover (DE)

(72) Inventors: Johannes Beer, Regensburg (DE); Lamproula Charmpa, Regensburg (DE); Bertrand Varoquie, Eaunes (FR)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

(21) Appl. No.: 17/320,875

(22) Filed: May 14, 2021

(65) Prior Publication Data

US 2021/0270195 A1 Sep. 2, 2021

Related U.S. Application Data

(63) Continuation of application No. PCT/EP2019/081227, filed on Nov. 13, 2019.

(30) Foreign Application Priority Data

Nov. 14, 2018 (DE) ..... DE10 2018 219 45 8
May 17, 2019 (DE) ..... 10 2019 207 252.6

(51) Int. Cl.
*F02D 35/02* (2006.01)
*F02D 41/00* (2006.01)
*F02P 5/153* (2006.01)

(52) U.S. Cl.
CPC ..... *F02D 35/028* (2013.01); *F02D 35/023* (2013.01); *F02D 41/0085* (2013.01); *F02P 5/153* (2013.01)

(58) Field of Classification Search
CPC ..... F02D 35/023; F02D 41/0085; F02D 2041/288; F02D 41/1497; F02D 41/008; F02D 35/028; F02P 5/153
(Continued)

(56) References Cited

U.S. PATENT DOCUMENTS 7,324,888 B1 * 1/2008 Stotsky ..... F02D 41/1498 701/101
7,395,148 B2 * 7/2008 Haraguchi ..... F02D 41/345 701/104
(Continued)

FOREIGN PATENT DOCUMENTS

DE 102008021443 A1 * 11/2009 ..... F02D 35/028
DE 102008021443 A1 11/2009
(Continued)

OTHER PUBLICATIONS

International Search Report and Written Opinion dated Feb. 19, 2020 from corresponding International Patent Application No. PCT/EP2019/081227.
(Continued)

*Primary Examiner* — Sizo B Vilakazi
*Assistant Examiner* — Brian R Kirby

(57) ABSTRACT

A method for detecting a cylinder-specific combustion profile parameter value for an internal combustion engine is described. The method includes the following: (a) detecting a toothed encoder signal, (b) determining a cylinder-specific tooth time interval on the basis of the toothed encoder signal, (c) determining a cylinder-specific phase value on the basis of a Fourier transformation of a part of the toothed encoder signal corresponding to the cylinder-specific tooth time interval, (d) determining the combustion profile parameter value on the basis of the cylinder-specific phase value and a stored transfer function which represents a relationship
(Continued)

between the combustion profile parameter and the phase value.

16 Claims, 3 Drawing Sheets

(58) Field of Classification Search
USPC ..... 123/445
See application file for complete search history.

(56) References Cited

U.S. PATENT DOCUMENTS 7,415,351 B2 * 8/2008 Raichle ..... F02D 35/024 701/107
7,516,732 B2 4/2009 Hagel et al.
7,853,393 B2 * 12/2010 Kettl ..... F02D 41/222 73/35.12
7,921,700 B2 * 4/2011 Raichle ..... F02D 41/3035 73/114.27
8,528,521 B2 * 9/2013 Landsmann ..... G01M 15/08 701/111
9,890,728 B2 * 2/2018 Fulton ..... F02D 41/1497
10,634,086 B1 * 4/2020 Fulton ..... F02D 35/023
10,739,232 B2 8/2020 Stola et al.
2003/0121499 A1 * 7/2003 Daniels ..... F02P 5/153 123/406.43
2005/0096834 A1 * 5/2005 Sgatti ..... G01M 15/046 701/111
2007/0266993 A1 * 11/2007 Kettl ..... F02D 35/023 123/436
2009/0095060 A1 * 4/2009 Serra ..... F02D 35/028 73/114.26
2009/0187325 A1 * 7/2009 Loeffler ..... F02D 35/028 701/102
2009/0312932 A1 12/2009 Wang et al.
2009/0312941 A1 * 12/2009 Wang ..... F02D 41/222 701/114
2010/0043400 A1 * 2/2010 Wang ..... F01N 11/002 60/299
2010/0083640 A1 * 4/2010 Wang ..... F02D 41/1462 60/286
2011/0083642 A1 * 4/2011 Landsmann ..... G01M 15/08 123/435
2012/0303240 A1 * 11/2012 Taibi ..... F02D 41/009 701/102
2015/0159569 A1 * 6/2015 Yu ..... F02D 41/009 73/114.16
2015/0315993 A1 * 11/2015 Nagai ..... F02D 35/023 701/102
2015/0322877 A1 * 11/2015 Eser ..... F02D 35/023 73/114.16
2017/0122839 A1 * 5/2017 Stola ..... G01B 21/22
2017/0363510 A1 * 12/2017 Varoquie ..... F02D 35/024
2019/0178223 A1 * 6/2019 Zhao ..... F02P 5/153
2019/0204183 A1 * 7/2019 Teichmann ..... G01M 15/08

FOREIGN PATENT DOCUMENTS

DE 102014220509 A1 4/2016
EP 3171006 A1 5/2017
WO 2005075804 A1 8/2005

OTHER PUBLICATIONS

Pischinger, R., Klell, M., & Sams, T., Thermodynamik der Verbrennungskraftmaschine (The Thermodynamics of the Internal Combustion Engine), Springer, 2002.

* cited by examiner

DETECTING CYLINDER-SPECIFIC COMBUSTION PROFILE PARAMETER VALUES FOR AN INTERNAL COMBUSTION ENGINE

CROSS-REFERENCE TO RELATED APPLICATIONS

This application claims the benefit of PCT Application PCT/EP2019/081227, filed Nov. 13, 2019, which claims priority to German Application DE 10 2019 207 252.6, filed May 17, 2019 and German Application 102018219458.0, filed Nov. 14, 2018. The disclosures of the above applications are incorporated herein by reference.

TECHNICAL FIELD

The disclosure relates to the technical field of internal combustion engines, in particular to a method for detecting a cylinder-specific combustion profile parameter value for an internal combustion engine. The present disclosure also relates to control devices for internal combustion engines and to a computer program.

BACKGROUND

An objective of development work in the field of engine combustion processes in internal combustion engines is to increase efficiency. The focus is on the following spark-ignition engine technologies for increasing efficiency by charge dilution: (1) cooled external exhaust gas recirculation (EGR) and (2) internal combustion engines with homogeneous lean operation.

The operation of the engine with charge dilution is limited by the engine-specific maximum dilution limit. The maximum dilution limit is determined by detecting the combustion stability variable "COV of IMEP".

In some known examples, the ignition angle (IGA) is determined by means of engine control using a predefined set of characteristic diagrams. IGA=f (engine temperature or coolant temperature, load, rotational speed, lambda, EGR . . . ). It is not taken into account here whether the parameters MFBxx resulting from the combustion are optimum with respect to the efficiency of the engine. For example, inaccuracies in the parameterization of characteristic diagrams and in the variation between engines can result in non-optimum MFBxx (MFB=mass fraction burned) values in the real operation of an engine.

In other known examples, there are engines which are equipped with a cylinder internal-pressure sensor in each individual cylinder. These are predominantly diesel engines. It is therefore possible to determine the parameters MFBxx for each cylinder and each individual combustion cycle and to take them into account for the optimization of the combustion. A disadvantage of this solution is the cost of the integration of a cylinder pressure sensor for each cylinder into the cylinder head of the engine along with the sensor costs.

R. Pischinger, Thermodynamik der Verbrennungskraftmaschine [The Thermodynamics of the Internal Combustion Engine], 2002, Springer, describes the calculation of the MFBxx from measurement of the cylinder pressure and from crank angle information and the relationship between the efficiency of an engine and MFBxx.

SUMMARY

The present disclosure provides a method and system for determining cylinder-specific combustion profile parameter values in a simple fashion and with high precision, for example, without using a cylinder pressure sensor in each individual cylinder.

According to a first aspect of the disclosure, a method for detecting a cylinder-specific combustion profile parameter value for an internal combustion engine is described. The described method includes the following steps: (a) detecting a toothed encoder signal, (b) determining a cylinder-specific tooth time interval on the basis of the toothed encoder signal, (c) determining a cylinder-specific phase value on the basis of a Fourier transformation of a part of the toothed encoder signal corresponding to the cylinder-specific tooth time interval, (d) determining the combustion profile parameter value on the basis of the cylinder-specific phase value and a stored transfer function which represents a relationship between the combustion profile parameter and the phase value.

Implementations of the disclosure may include one or more of the following optional features. In some implementations, the described method is based on the realization that a relationship (in the form of a stored transfer function), which is known (from laboratory measurements), between an actual or real value of the combustion profile parameter and a phase value, determined from the phase spectrum of the cylinder-relevant part of the toothed encoder signal, is used to determine the cylinder-specific combustion profile parameter value. Therefore, the disclosure makes it possible to detect a cylinder-specific combustion profile parameter value without using a cylinder pressure sensor.

In this document, the term "toothed encoder signal" denotes an electrical signal which is detected by a crankshaft position sensor and a toothed encoder wheel (for example, a 60-2 toothed encoder wheel) which is mounted in a known fashion on the crankshaft. The toothed encoder signal therefore generally permits the position and rotational speed of the crankshaft to be determined.

In this document, the term "tooth time" denotes a time period between the respective processes of detecting adjacent toothed encoder wheel teeth by the crankshaft position sensor. The tooth time can be determined as a function of the crank angle.

In this document, "cylinder-specific tooth time interval" denotes the part of the above-mentioned function (i.e. tooth time over crank angle) in which the respective cylinder is active. In other words, the "cylinder-specific tooth time interval" denotes a time interval (corresponding to the crankshaft interval) which begins at the start of the expansion phase of the respective cylinder and ends at the beginning of the expansion phase of the following cylinder.

In some implementations, the determination of the cylinder-specific phase value also includes an offset correction for determining an offset-corrected cylinder-specific phase value.

The offset correction serves to compensate tolerances in the toothed encoder wheel and in the toothed encoder signal detection.

In some examples, the offset correction includes determining a mean value of a multiplicity of cylinder-specific phase values during an overrun phase.

In this document, the term "overrun phase" denotes a phase in which the internal combustion engine is operated at an (at least approximately) constant engine speed without combustion.

In an ideal case, this mean value is equal to zero. A value which differs from zero therefore constitutes the tolerance-induced offset.

In some examples, the offset-corrected cylinder-specific phase value is determined by subtracting the determined mean value from the cylinder-specific phase value.

In some implementations, the combustion profile parameter value is determined on the basis of a mean value of a plurality of cylinder-specific phase values of a cylinder.

In other words, a plurality of phase values are determined for the respective cylinder. The mean value of this series of phase values is then used to determine the combustion profile parameter value for the cylinder by way of the stored transfer function.

In some implementations, the internal combustion engine has a reference cylinder with a cylinder pressure sensor. The method also includes the following steps of: (a) detecting a pressure value for the reference cylinder, (b) determining the combustion profile parameter value for the reference cylinder on the basis of the pressure value, (c) determining the cylinder-specific phase value both for the reference cylinder and for the further cylinder, (d) determining the combustion profile parameter value for the further cylinder on the basis of the combustion profile parameter value for the reference cylinder, the phase value for the reference cylinder, the phase value for the further cylinder and the stored transfer function.

In example, a cylinder pressure sensor is provided in a reference cylinder, where the further cylinders of the internal combustion engine do not have such a sensor. First of all, the combustion profile parameter value for the reference cylinder is determined on the basis of the cylinder pressure signal in a manner known per se. The cylinder-specific phase values both for the reference cylinder and for a further cylinder are then determined and used together with the previously determined combustion profile parameter value for the reference cylinder and the stored transfer function to determine the combustion profile parameter value for the further cylinder.

In some implementations, the method further includes calculating a difference between the value of the transfer function for the phase value of the further cylinder and the value of the transfer function for the phase value of the reference cylinder, where the combustion profile parameter value for the further cylinder is determined by adding the combustion profile parameter value for the reference cylinder and the calculated difference.

In other words, corresponding values of the stored transfer function are calculated and subtracted for both phase values (i.e. for the phase value of the further cylinder and the phase value of the reference cylinder). This difference is then added to the previously determined combustion profile parameter value for the reference cylinder in order to determine the combustion profile parameter value for the further cylinder.

In some examples, the cylinder-specific combustion profile parameter value is a burnt fuel mass fraction MFBxx, for example, an MFB50 value.

Other combustion profile parameter values, such as MFB10 or MFB90, can, however, be determined in a similar manner.

Another aspect of the disclosure provides a control device for an internal combustion engine. The described control device has a processing unit which is configured to carry out the method according to the first aspect or according to one of the examples described above. The control device also has a data memory in which the transfer function is stored.

The control device provides the advantages of the methods described above, for example in a motor vehicle.

Another aspect of the disclosure provides a computer program which, when executed by a processor, is designed to carry out the method according to the first aspect or one of the examples described above.

Within the meaning of this document, the designation of a computer program of this kind is equivalent to the concept of a program element, a computer program product and/or a computer-readable medium which contains instructions for controlling a computer system, in order to coordinate the manner of operation of a system or of a method in a suitable manner, in order to achieve the effects associated with the method according to the disclosure.

The computer program can be implemented as a computer-readable instruction code in any suitable programming language, such as in JAVA, C++, etc. for example. The computer program can be stored on a computer-readable storage medium (CD-ROM, DVD, Blu-ray disk, removable drive, volatile or non-volatile memory, integral memory/processor, etc.). The instruction code can program a computer or other programmable devices, such as a control device for an engine of a motor vehicle for example, in such a way that the desired functions are executed. Furthermore, the computer program may be provided in a network such as, for example, the Internet, from which a user can download it as required.

The disclosure can be implemented both by a computer program, i.e. software, and by one or more specific electrical circuits, i.e. as hardware or in any desired hybrid form, i.e. by software components and hardware components.

It should be noted that examples of the disclosure have been described with reference to different subjects of the disclosure. In particular, some examples of the disclosure are described by way of method claims and other examples of the disclosure are described by way of device claims. However, it will become immediately clear to a person skilled in the art on reading this application that, unless explicitly stated otherwise, in addition to a combination of features which are associated with one type of subject matter of the disclosure, any combination of features which are associated with different types of subjects of the disclosure is also possible.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

According to the disclosure, a toothed encoder signal is detected by a crankshaft position sensor and a toothed encoder wheel (e.g., a 60-2 toothed encoder wheel) mounted on the crankshaft and a corresponding tooth time interval is determined from this for each cylinder.

Figure 1:
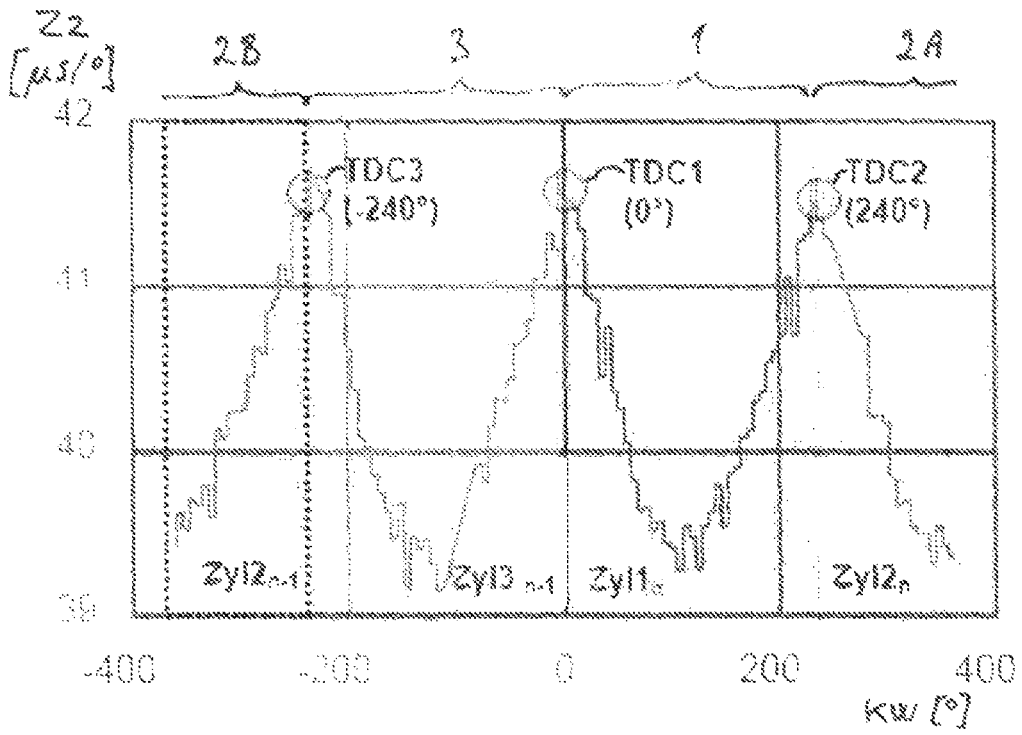
FIG. 1 shows a relationship between the tooth time and the crank angle with three tooth time intervals.

FIG. 1 shows a corresponding relationship between a tooth time Zz (μs/°) and a crank angle KW (°) with three tooth time intervals 1, 2A, 2B, 3 according to one example. The depiction corresponds to three revolutions of a three-cylinder engine. The first tooth time interval 1 (or crank angle interval) begins at the start of the expansion phase at TDC1, i.e. the top dead center ignition for cylinder 1 (corresponding to a crank angle KW equal to 0°) in cycle n, and ends when the top dead center TDC2 (corresponding to a crank angle KW equal to 240°) for the following (second) cylinder is reached. This is followed immediately by the second tooth time interval, which in the illustration consists of a part 2A in cycle n (crank angle KW between 240° and 360°) and a part 2B in the previous cycle n−1 (crank angle KW between −360° and −240°). In the illustration in FIG. 1, the third tooth time interval 3 lies immediately before the first tooth time interval 1, i.e. between TDC3 (KW equals −240°) and TDC1 (KW equals 0°) in cycle n−1. For the present three-cylinder engine, there is an associated tooth time interval with a length of 240° crank angle for each cylinder and for each work cycle. The tooth time interval is determined in the engine control while the engine is in operation.

A Fourier transformation is then carried out for the tooth time interval assigned to each working cycle of a cylinder. As a result of the transformation, amplitude and phase information is obtained for each integral multiple of the fundamental frequency (first harmonic frequency).

Figure 2:
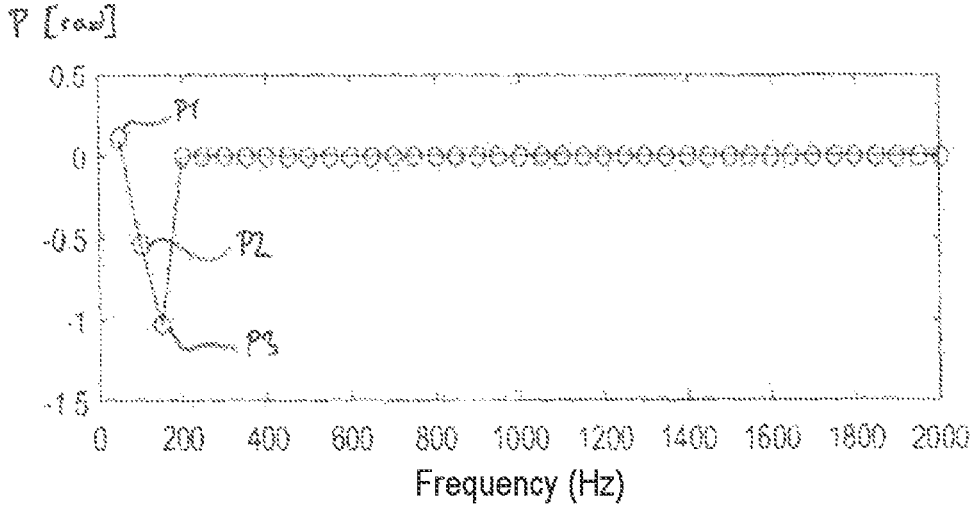
FIG. 2 shows a phase spectrum determined for a tooth time interval in FIG. 1.

FIG. 2 shows a phase spectrum determined according to the disclosure for a tooth time interval in FIG. 1, for example, for the part of the toothed encoder signal which corresponds to the tooth time interval 3. The phase value P1 corresponds to the fundamental frequency or the first harmonic frequency, the phase value P2 corresponds to the second harmonic frequency, and the phase value P3 corresponds to the third harmonic frequency.

According to the disclosure, the phase information of the first harmonic frequency, i.e. the value P1 in FIG. 2, is used to determine the MBxx combustion parameters. This phase information or this phase value is generally designated $PHI_{cy1=i_n}$ for cylinder i and combustion cycle n. The desired combustion profile parameter value, e.g. MFB50, can now be determined on the basis of the phase value and a stored transfer function.

An offset correction is carried out first to improve the precision. For this purpose, the internal combustion engine is operated at an approximately constant engine speed without combustion, e.g. in the overrun phase. This results in cylinder- and speed-dependent values for $PHI_{cy1=i_n}$, which are referred to below as $PHI_{cy1=i_n_motorized}$.

Figure 3:
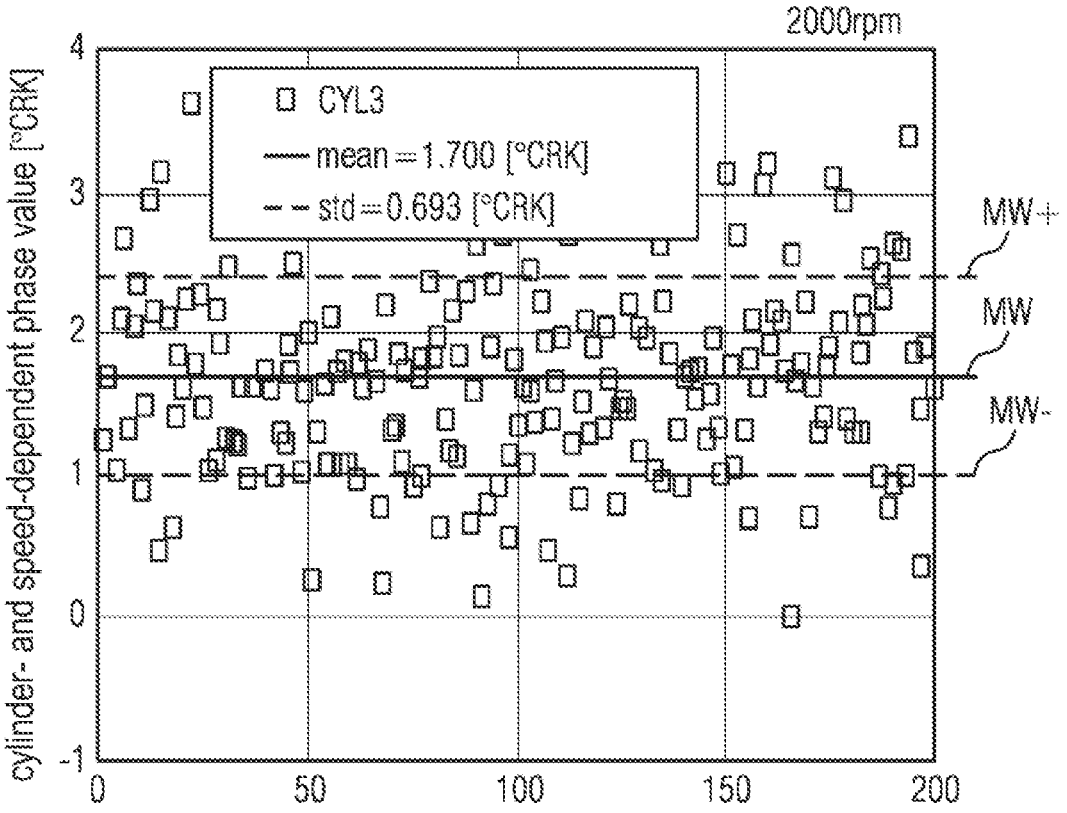
FIG. 3 shows a series of measured phase values for the determination of an offset correction value for a cylinder.

The values $PHI_{cy1=i_n_motorized}$ are different from zero due to tolerances in the crankshaft signal detection and in the 60-2 toothed encoder wheel and exhibit a statistical spread. This is shown in FIG. 3, which shows a measurement of phase values for cylinder 3 at an engine speed of 2000 rpm. The mean value MW (e.g., over approx. 100-200 cycles per cylinder) represents the systematic error in the determination of $PHI_{cy1=i_n}$. The dashed lines MW+ and MW− show the corresponding standard deviation. The series of measured phase values shown in FIG. 3 can be used for the determination of an offset correction value for the cylinder.

The accuracy of the method is improved by correcting the values $PHI_{cy1=i_n}$ for this systematic offset error. The offset correction value is typically determined once per driving cycle via the engine control device. The corrected phase values are denoted as $PHI_{cy1=i_n}$ adapted and are determined as follows:

$$PHI_{cyl=i_n_adapted} = PHI_{cyl=i_n} - \frac{1}{\text{number of cycles}} \sum_{n=1}^{number\ of\ cycles} PHI_{cyl=i_n_motorized}$$

Figure 4:
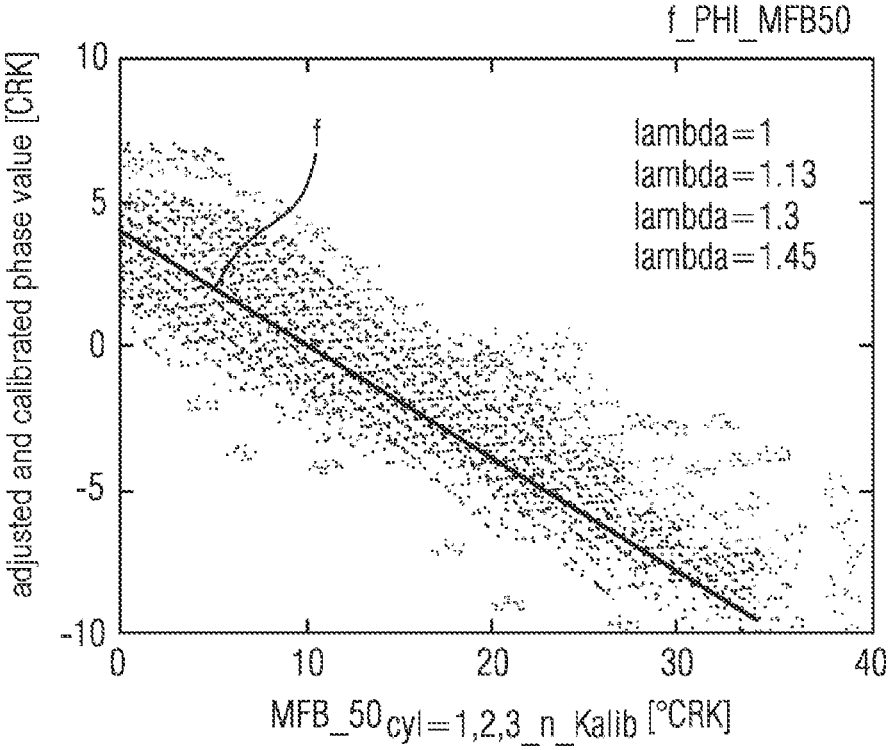
FIG. 4 shows a representation of measured phase values and combustion profile parameter values for determining a transfer function.

The abovementioned transfer function is stored in the engine control device and is generally determined in the laboratory (for the respective engine type). FIG. 4 shows a representation of phase values measured (in the laboratory) and combustion profile parameter values for determining a transfer function according to the disclosure, such as the transfer function f_PHI_MBF50, which can be used to determine the combustion profile parameter value MBF50 from determined phase information.

For the calibration of the method according to the disclosure, a representative vehicle is used in the development process. Alternatively, an engine can also be used on an engine test bench if it can be ensured that the drive train dynamics correspond to the dynamics in the vehicle. Each cylinder of the engine is equipped with a reference cylinder pressure measurement (e.g. Kistler sensor). The reference MFB50 values are determined during calibration ($MFBxx_{cy1=i_n_Kaitb}$) using a commercial indexing system such as AVL Indiset. Under steady-state engine conditions, approx. 200 combustion cycles per cylinder are recorded using the indexing system. In other words: $MFBxx_{cy1=i_n_Kalib}$=Reference MFBxx from Indiset for cylinder i and combustion cycle n.

In addition to the values of $MFB_xx_{cy1=i_n_Kalib}$, the values of $PHI_{cy1=i_n}$ are also recorded for the calibration.

The calibration process includes the following engine conditions:

(a) Steady-state load and speed points at which the variables MFB_xx are to be detected during later operation of the vehicle.

(b) For each load point from (a) a variation of the charge dilution in several steps. Depending on the application,
  (i) the external cooled EGR rate varies in several steps between EGR=0% and the maximum possible EGR rate or
  (ii) for homogeneous lean operation, the combustion lambda, starting from lambda=1, varies in several steps up to the maximum possible lambda.

(c) For each load point from (a) and each dilution state from (b), the combustion characteristics MFBxx are varied by varying the ignition angle.

In addition, during the calibration, a drag measurement is carried out for each speed, as described above, and the values $PHI_{cy1=i_n_adapted_Kalib}$ are calculated using the offset correction on the basis of the recorded data.

In the next step, the recorded cycle-specific and cylinder-specific variables $MFBxx_{cy1=i_n_Kalib}$ and $PHI_{cy1=i_n_adapted_Kalib}$ are plotted against each other for each load point from (a) for the measurements from (b) and (c), as shown in FIG. 4.

The linear transfer function f_PHI_MFBxx can now be determined for each load point from (a) and the associated variations from (b) and (c) using a least square method. In FIG. 4, f_PHI_MFB50 is shown as a solid line f.

According to the disclosure, this transfer function is now used to determine the combustion profile parameter value (for example, MFB50) based on the phase values $PHI_{cy1=i_n_adapted}$ which are determined and offset-corrected (as described above).

Thus, with the method according to the disclosure, the combustion profile parameter value can be determined precisely without using cost-increasing cylinder internal-pressure sensors:

$$MFBxx_{cy1=i_n}=f_PHI_MFBxx(PHI_{cy1=i_n_adapted}).$$

To reduce the cycle-to-cycle spread, it is advantageous to average the value over the number of M combustion cycles:

$$MFBxx_{cyl=i} = \frac{1}{M}\Sigma_{n=1}^{M} MFBxx_{cyl=i_n}$$

In a further example, a cylinder internal-pressure sensor can be installed in a single cylinder (reference cylinder) of the engine. The variable $MFBxx_{Ref_n}$ is determined using the pressure signal of the sensor and the combustion profile calculation in the engine control. Phase values are determined both for the reference cylinder and for a further cylinder (without an internal pressure sensor) and then the measured reference variable $MFBxx_{Ref_n}$ can be used to improve the determination of $MFBxx_{cy1=i_n}$ for each/the further cylinder which is not equipped with a cylinder internal-pressure sensor:

$$MFBxx_{cy1=i_n}=MFBxx_{Ref_n}+f_PHI_MFBxx(PHI_{cy1=i_n_adapted})-f_PHI_MFBxx(PHI_{Ref_n_adapted})$$

The spread (cycle to cycle) can also be reduced here by averaging.

Figure 5:
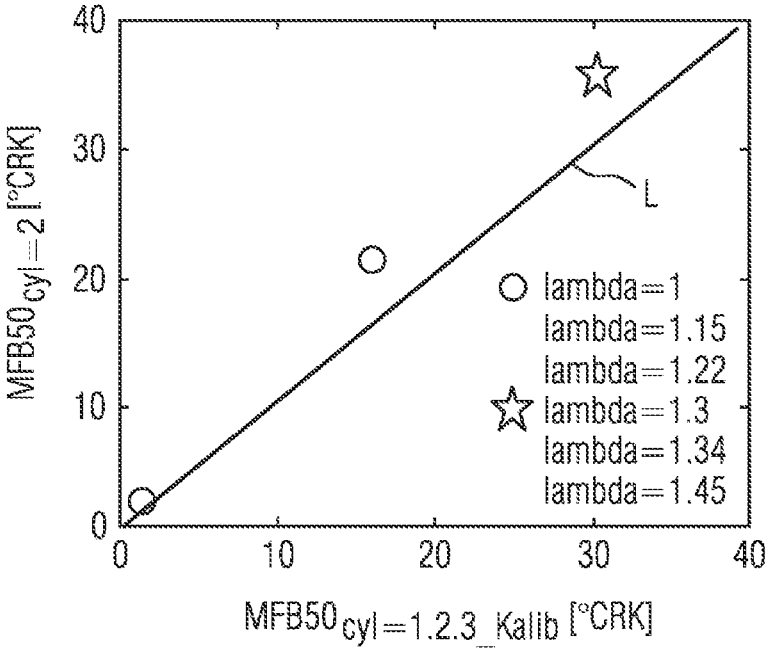
FIG. 5 shows a comparison between actual combustion profile parameter values and determined combustion profile parameter values.

FIG. 5 shows a comparison between actual combustion profile parameter values and combustion profile parameter values determined according to the disclosure. All the values are on, or in the immediate vicinity of the line L and thus indicate a very good match.

In summary, the present disclosure provides precise determination of combustion profile parameter values either entirely without cylinder internal-pressure sensors or with only one such sensor.

A number of implementations have been described. Nevertheless, it will be understood that various modifications may be made without departing from the spirit and scope of the disclosure. Accordingly, other implementations are within the scope of the following claims.

LIST OF REFERENCE DESIGNATIONS

1 Tooth time interval
2A, 2B Tooth time interval
3 Tooth time interval
Zz Tooth time
KW Crank angle
TDC1 Top dead center
TDC2 Top dead center
TDC3 Top dead center
P Phase value
P1 Phase value
P2 Phase value
P3 Phase value
MFBxx xx % Mass fraction burned, burned mass fraction of fuel
MW Mean value
MW+ Standard deviation
MW+ Standard deviation
f Transfer function
L Line

What is claimed is:

1. A method for detecting a cylinder-specific combustion profile parameter value for an internal combustion engine, the internal combustion engine having a reference cylinder with a cylinder pressure sensor and one or more non-reference cylinders, the method comprising:

detecting a toothed encoder signal;

determining a cylinder-specific tooth time interval for the reference cylinder based on the toothed encoder signal;

detecting a pressure value for the reference cylinder based on the cylinder pressure sensor;

determining the combustion profile parameter value for the reference cylinder based on the pressure value;

determining a cylinder-specific phase value for the non-reference cylinder based on a Fourier transformation of a part of the toothed encoder signal corresponding to the cylinder-specific tooth time interval for the reference cylinder;

determining a phase value for the reference cylinder;

determining the cylinder-specific combustion profile parameter value for the non-reference cylinder based on:

the cylinder-specific phase value for the non-reference cylinder, a stored transfer function which represents a relationship between the cylinder-specific combustion profile parameter and the phase value for the non-reference cylinder, the stored transfer function determined based on previously measured phase values and associated combustion profile parameter values, the combustion profile parameter value for the reference cylinder, and the phase value for the reference cylinder; and optimizing combustion of the internal combustion engine based on the cylinder-specific combustion profile parameter value for the non-reference cylinder.

2. The method as claimed in claim 1, wherein the determination of the cylinder-specific phase value for the non-reference cylinder also comprises an offset correction for determining an offset-corrected cylinder-specific phase value.

3. The method as claimed in claim 2, wherein the offset correction comprises determining a mean value of a multiplicity of cylinder-specific phase values during an overrun phase.

4. The method as claimed in claim 3, wherein the offset-corrected cylinder-specific phase value is determined by subtracting the determined mean value from the cylinder-specific phase value.

5. The method as claimed in claim 1, wherein the combustion profile parameter value is determined based on a mean value of a plurality of cylinder-specific phase values of a cylinder.

6. The method as claimed in claim 1, further comprising:

calculating a difference between the value of the transfer function for the phase value of the non-reference cylinder and the value of the transfer function for the phase value of the reference cylinder, wherein the combustion profile parameter value for the non-reference cylinder is determined by adding the combustion profile parameter value for the reference cylinder and the calculated difference.

7. The method as claimed in claim 1, wherein the cylinder-specific combustion profile parameter value is a burnt fuel mass fraction MFBxx.

8. The method as claimed in claim 7, wherein the burnt fuel mass fraction MFBxx is an MFB50 value.

9. A control device for an internal combustion engine, the internal combustion engine having a reference cylinder with a cylinder pressure sensor and one or more non-reference cylinders, the control device comprising:

a data memory storing a transfer function; and a processing unit detecting a cylinder-specific combustion profile parameter value for an internal combustion engine, the processing unit configured to:

detect a toothed encoder signal;

determine a cylinder-specific tooth time interval based on the toothed encoder signal;

detect a pressure value for the reference cylinder;

determine the combustion profile parameter value for the reference cylinder based on the pressure value;

determine a cylinder-specific phase value for the non-reference cylinder based on a Fourier transformation of a part of the toothed encoder signal corresponding to the cylinder-specific tooth time interval;

determine a phase value for the reference cylinder;

determine the cylinder-specific combustion profile parameter value for the non-reference cylinder based on:

the cylinder-specific phase value for the non-reference cylinder, a stored transfer function which represents a relationship between the cylinder-specific combustion profile parameter and the phase value for the non-reference cylinder, the stored transfer function determined based on previously measured phase values and associated combustion profile parameter values, the combustion profile parameter value for the reference cylinder, and the phase value for the reference cylinder; and optimize combustion of the internal combustion engine based on the cylinder-specific combustion profile parameter value for the non-reference cylinder.

10. The control device as claimed in claim 9, wherein the determination of the cylinder-specific phase value also comprises an offset correction for determining an offset-corrected cylinder-specific phase value.

11. The control device as claimed in claim 10, wherein the offset correction comprises determining a mean value of a multiplicity of cylinder-specific phase values during an overrun phase.

12. The control device as claimed in claim 11, wherein the offset-corrected cylinder-specific phase value is determined by subtracting the determined mean value from the cylinder-specific phase value.

13. The control device as claimed in claim 9, wherein the combustion profile parameter value is determined based on a mean value of a plurality of cylinder-specific phase values of a cylinder.

14. The control device as claimed in claim 9, wherein the processing unit is further configured to:

calculate a difference between the value of the transfer function for the phase value of the further cylinder and the value of the transfer function for the phase value of the reference cylinder, wherein the combustion profile parameter value for the non-reference cylinder is determined by adding the combustion profile parameter value for the reference cylinder and the calculated difference.

15. The control device as claimed in claim 9, wherein the cylinder-specific combustion profile parameter value is a burnt fuel mass fraction MFBxx.

16. The control device as claimed in claim 15, wherein the burnt fuel mass fraction MFBxx is an MFB50 value.

* * * * *